United States Patent [19]

Dahlquist

[11] 3,973,642

[45] Aug. 10, 1976

[54] NOISE-REDUCING BLOWING NOZZLE

[75] Inventor: Lars Christer Dahlquist, Atvidaberg, Sweden

[73] Assignee: Sunne Gummifabrik AB, Sunne, Sweden

[22] Filed: Apr. 1, 1975

[21] Appl. No.: 564,082

[30] Foreign Application Priority Data

Apr. 5, 1974 Sweden ..... 74046087

[52] U.S. Cl. ..... 181/36 A; 15/326; 239/590.3; 239/DIG. 21

[51] Int. Cl.[2] ..... F01N 5/00

[58] Field of Search ..... 15/326; 239/590, 590.3, 239/590.5, 602, DIG. 19, DIG. 21, DIG. 22; 181/35 R, 36 A, 36 B, 50, 60, 71

[56] References Cited

UNITED STATES PATENTS

| | | | |
|---|---|---|---|
| 2,152,205 | 3/1939 | Morrison | 181/71 X |
| 2,169,359 | 8/1939 | Jones et al. | 181/71 X |
| 3,537,543 | 11/1970 | Gibel | 181/36 A |
| 3,698,510 | 10/1972 | Blatt et al. | 181/36 A |

*Primary Examiner*—Lawrence R. Franklin
*Attorney, Agent, or Firm*—Cushman, Darby & Cushman

[57] ABSTRACT

A jet nozzle is described in which the noise is greatly reduced. It comprises a tapering thick-walled tube of rubber or plastic, to the wider end of which a pressurized fluid is supplied through a porous filter body retained by a cup-shaped bowl having a perforated bottom.

9 Claims, 1 Drawing Figure

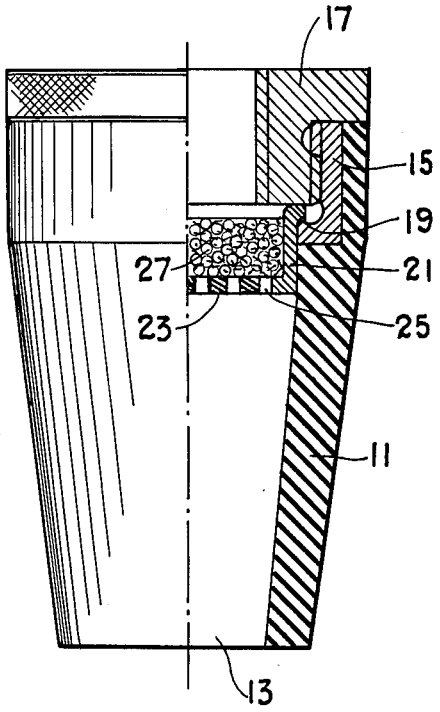
17
15
19
27
21
23
25
11
13

NOISE-REDUCING BLOWING NOZZLE

The invention relates to a blowing nozzle adapted to be applied to the end of a conduit for supplying compressed air or other pressurized fluid to clean machines or work pieces or to eject or remove work pieces from working machines such as punching or pressing machines. The object of the invention is to obtain a high degree of noise reduction and to enable a convenient renewal of a filter body forming part of the nozzle.

According to the present invention there is provided a noise-reducing blowing nozzle comprising a thick-walled rubber or plastics tube having a length greater, preferably 30 to 100 per cent greater than its maximum diameter and tapering with a cone apex angle of between 9° and 15° towards an outlet orifice, a cup-shaped bowl having a perforated bottom removably inserted therein and retaining a porous filter body such as a disc of foamed plastics or nylon fibre, the rim of said bowl resting against a shoulder of a metal sleeve inserted into the wide end of the rubber tube and attached thereto by moulding or vulcanisation.

The nozzle will now be described with reference to the accompanying drawing showing the nozzle in part side and part axial sectional views.

The main part of the nozzle consists of a thick-walled conically tapering rubber tube 11 which is substantially undistorted by pressure fluid and is attached at its wider end to a conduit for supply of pressure air, or possibly steam; its narrower end has an open orifice 13 through which the pressure fluid flows out freely, to be directed towards the spot on a machine or a work piece to be blown clean.

In a preferred embodiment the tube is one-half of the dimensions shown in the drawing, but of course, these dimensions may be varied within wide limits. Extensive tests have made it clear that certain measurements must be kept in order to get the highest possible noise reduction. Thus the tube must not be shorter than its maximum diameter, and the cone taper is also important. It has been proved that the cone apex angle is preferably about 11°, but can be varied between 9° and 15° e.g. the angle between the nozzle centre line and a genetrix line of the inside of the tube amounts to one-half of said values. Furthermore, the rubber material should preferably be of a hardness of between 60 and 90 IRH and be oil resistant. Preferably the wall thickness of the tube increases somewhat towards the wider end.

In the wide or attachment end of the tube there is inserted a metal sleeve 15 which is attached by moulding or vulcanisation to the cylindrical end part of the rubber tube. This sleeve is internally threaded and screwed onto a nipple 17 connected to the pressure air conduit (not shown). The rim 19 of a cup-shaped bowl is clamped against a shoulder of the sleeve 15 by means of the nipple. The bowl has a cylindrical portion 21 closely fitting to the inside of the rubber tube, which is cylindrical at this spot, and has a flat bottom 23 extending across the entire open cross-section of the rubber tube. The bowl is pressed out of sheet steel and its bottom is pierced by a number of evenly distributed holes 25 of a diameter of between 1.5 and 2.5 mm. The total area of the holes is between 30 and 50 per cent, preferably 35 per cent, of the total area of the bottom or of the total aperture area of the wide end of the rubber tube. Loosely fitted in the bowl 21, 23 is a porous filter body 27 which consists of a disc of foamed rubber, or nylon fibre, the thickness of which is somewhat less than the axial height of the cylindrical part 21 of the bowl. As the filter body will be pressed into and clog the perforation holes with time, it should be renewed from time to time. This can easily be performed by unscrewing the nipple 17 and ejecting the bowl 21, 23 which thereafter can be cleaned and equipped with a new insert.

In an alternative embodiment, the length of the rubber tube is 2 to 3 times the diameter of the wide end, and the outlet orifice 13 has an area of one fourth or less of the area of the bowl bottom, 23.

The sound caused by the air jet is due to phenomena occurring during air passage through the holes 25. The air eddies produced are strongest near the hole exits and within the cavity of the rubber tube, and the sound produced by them is mostly absorbed by the rubber material leaving only a reduced amount of external noise issuing from the orifice 13. The porous filter body 27 acts to subdue noise travelling in the opposite direction and transmitted to the outside via the bowl 21 and the nipple 17.

Although rubber has proved to be a suitable material for the tube 11 it is also possible to use a plastics material having comparable properties in respect of sound suppression.

What I claim is:

1. A noise-reducing blowing nozzle comprising a thick-walled tube constructed of a material selected from the group consisting of rubber and plastic, said tube having a length greater than its maximum diameter and tapering with a cone apex angle of between 9° and 15° towards an outlet orifice, a cup-shaped bowl having a perforated bottom removably inserted in said tube and retaining a porous filter body, said bowl having a rim resting against a shoulder of a metal sleeve inserted into the wide end of the rubber tube and attached thereto, the diameter of the bowl holes being between 1.5 and 2.5 mm, and their total area being between 30 and 50 per cent of the bottom area of the bowl.

2. A nozzle according to claim 1, wherein the rim of the bowl is clamped between a shoulder of the metal sleeve and a nipple threaded therein and serving to connect the nozzle to a pressure fluid conduit.

3. A nozzle according to claim 1, wherein the cylindrical part of the cup-shaped bowl closely fits against the inner wall of the tube.

4. A nozzle as in claim 1 wherein the porous filter body is a disc constructed of a material selected from the group consisting of foamed plastic and nylon fibre.

5. A nozzle as in claim 1 wherein the sleeve is attached to the tube by molding.

6. A nozzle as in claim 1 wherein the sleeve is attached to the tube by vulcanization.

7. A nozzle for ejecting compressed air, comprising a tapering rubber tube, a metal sleeve vulcanised to the inside of the wide end of said rubber tube, an air supply conduit nipple threaded into said sleeve, a cup-shaped perforated bowl inserted in said rubber tube end and applied with a rim portion against said sleeve, and a body of porous material held by said bowl.

8. A nozzle as claimed in claim 7, in which the length of the rubber tube is 1.3 to 3 times the maximum diameter thereof and in which the interior of the tube tapers with an apex angle of 9° to 15°.

9. A nozzle as claimed in claim 7, in which the perforation holes of the bowl is of a diameter of 1.5 to 2.5 mm and their total area is between 30 and 50 per cent of the total aperture area of the wide end of the rubber tube.

* * * * *